US007210532B2

(12) United States Patent
Sherwood et al.

(10) Patent No.: US 7,210,532 B2
(45) Date of Patent: May 1, 2007

(54) METHOD AND APPARATUS FOR LIFTING LIQUIDS FROM GAS WELLS

(75) Inventors: John Sherwood, Cambridge (GB); Ian Atkinson, Ely (GB); Barry Nicholson, Carindale (AU)

(73) Assignee: Schlumberger Technology Corporation, Ridgefield, CT (US)

( * ) Notice: Subject to any disclaimer, the term of this patent is extended or adjusted under 35 U.S.C. 154(b) by 258 days.

(21) Appl. No.: 10/849,745

(22) Filed: May 20, 2004

(65) Prior Publication Data

US 2005/0155769 A1 Jul. 21, 2005

(30) Foreign Application Priority Data

Jun. 3, 2003 (GB) ..... 0312652.1

(51) Int. Cl.
*E21B 43/18* (2006.01)
*F04F 1/08* (2006.01)

(52) U.S. Cl. ..... 166/372; 166/370; 166/105; 137/155

(58) Field of Classification Search ..... 166/370, 166/372, 105, 68, 313; 137/155
See application file for complete search history.

(56) References Cited

U.S. PATENT DOCUMENTS 5,636,693 A 6/1997 Elmer
5,904,209 A 5/1999 Kenworthy et al.
5,937,946 A 8/1999 Streetman
5,957,199 A 9/1999 McLean et al.
6,059,040 A 5/2000 Levitan et al.
2002/0029888 A1* 3/2002 Swensen ..... 166/370
2004/0144545 A1* 7/2004 Lauritzen et al. ..... 166/369

FOREIGN PATENT DOCUMENTS

GB 2 261 030 A 5/1993

OTHER PUBLICATIONS

Hutlas et al, A practical approach to removing gas well liquids, Journal of Petroleum Technology, Aug. 1972, pp. 916-922.
Turner et al, Analysis and prediction of minimum flow rate for the continuous removal of liquids from gas wells, SPE 2198 (Society of the Petroleum Engineers of AIME), Nov. 1969, pp. 1475-1482.

* cited by examiner

*Primary Examiner*—Jennifer H. Gay
*Assistant Examiner*—Robert E Fuller
(74) *Attorney, Agent, or Firm*—Edward M. Bushard; Steven Gahlings; Jody Lynn DeStefanis

(57) ABSTRACT

A downhole apparatus and method for maintaining or reducing the level of liquids at the bottom of a gas producing well is described including a constriction or throat section, such as a Venturi, in which a production gas flow from the well is used to generate a low pressure zone having a pressure less that the ambient formation gas pressure and at least one conduit providing a flow path from an up-stream location within said well to said low pressure zone. The conduit may have additional opening for production gas to enter the conduit.

20 Claims, 9 Drawing Sheets

60

METHOD AND APPARATUS FOR LIFTING LIQUIDS FROM GAS WELLS

The present invention generally relates to an apparatus and a method for removing liquids from the bottom section of gas producing wells.

BACKGROUND OF THE INVENTION

Many gas wells produce liquids in addition to gas. These liquids include water, oil, and condensate. As described in the paper SPE 2198 of the Society of Petroleum Engineers of AIME, authored by R. G. Turner, A. E. Dukler, and M. G. Hubbard, "in many instances, gas phase hydrocarbons produced from underground reservoirs will have liquid-phase material associated with them, the presence of which can effect the flowing characteristics of the well. Liquids can come from condensation of hydrocarbon gas (condensate) or from interstitial water in the reservoir matrix. In either case, the higher density liquid phase, being essentially discontinuous, must be transported to the surface by the gas. In the event the gas phase does not provide sufficient transport energy to lift the liquids out of the well, the liquid will accumulate in the well bore. The accumulation of the liquid will impose an additional back pressure on the formation and can significantly affect the production capacity of the well". Over time, accumulated liquid can cause a complete blockage and provoke premature abandonment of the well. Removal of such liquid restores the flow of gas and improves utilization and productivity of a gas well.

There are many technical solutions that have been suggested in the prior art to solve the problem of accumulating liquids. Some of them are described briefly by E. J. Hutlas and W. R. Granberry in the article entitled "A Practical Approach to Removing Gas Well Liquids" in the Journal of Petroleum Technology, August 1972, p. 916–922. Others are summarized in the U.S. Pat. No. 5,904,209. More recent advances in operating gas and other hydrocarbon wells are found for example in the U.S. Pat. Nos. 5,636,693; 5,937,946; 5,957,199 and 6,059,040.

Submersible pumps may also be used to overcome the above-described problem. However the costs of deploying such pumps are often not justified for low margin gas wells On the other hand, it is known that production from low pressure reservoirs can be enhanced by jet pumps and artificial lift operations. For instance, hydraulic jet pumps have been used as a down hole pump for artificial gas lift applications. In these types of hydraulic pumps, the pumping action is achieved through energy transfer between two moving streams of fluid. The power fluid at high pressure (low velocity) is converted to a low pressure (high velocity) jet by a nozzle or throat section in the flow path of the power fluid. The pressure at the throat becomes lower as the power fluid flow rate is increased, which is known as the Venturi effect. When this pressure becomes lower than the pressure in the suction passageway, fluid is drawn in from the well bore. The suction fluid becomes entrained with the high velocity jet and the pumping action then begins. After mixing in the throat, the combined power fluid and suction fluid is pumped to the surface.

In the light of the above background it is an object of the present invention to provide effective and economically viable methods and apparatus for cleaning gas wells.

SUMMARY OF THE INVENTION

In accordance with a first aspect of the invention, there is provided an apparatus for reducing the level of liquids at the bottom of a gas producing well comprising a constriction or throat section in which a production gas flow from the well generates a low pressure zone having a pressure less than the ambient formation gas pressure and at least one conduit providing a flow path from an up-stream location within said well to said low pressure zone.

The invention proposes to exploit the flow of the produced gas to create a differential pressure between a location that is preferably located above the producing zone and a location that represents the maximum tolerable level of liquids in the well. The latter level is preferably set below the gas producing zone and hence most preferably immediately below the lowest perforation penetrating the gas bearing formation. The height or distance that separates these two locations and over which the apparatus lifts the liquid may span more than 5 meters, in some wells even more than 15 meters.

Preferably, the constriction is a Venturi-type constriction having an extended section of small diameter in between two sections where the flow pipe diameter tapers from its nominal diameter to the small diameter. However other constrictions such as orifice plates may be used.

The flow path between the up-stream location and the low pressure zone is provided by a conduit such as a tubular pipe. The conduit is preferably straight as even a limited number of bends in the tube induce a pressure drop that is lost for lifting the liquids. Its upper end preferably terminates at a location where the constriction has its minimal diameter. The conduit itself is best made of resilient material, such as steel, capable of withstanding the wear and tear in a subterranean environment.

In a preferred embodiment the conduit is flexible or capable of expanding and contracting, e.g. in a telescopic manner, in the longitudinal direction. When attaching a floater to its lower end, the conduit is adaptable to a changing level of liquid in the well.

In another preferred embodiment the conduit has at least one additional opening at a position between the two locations, hence, in a section of the well where gas is produced and can enter the tube through the additional openings thus provided. The gas reduces the weight of the liquid flowing through the conduit.

Whilst the openings could in principle be located along the length of the conduit it is preferred to position them at one location distributed around the circumference of the conduit. Most preferably the number of openings is restricted to exactly one, as it was found that additional openings do not result in a significantly increased performance of the apparatus.

When used in combination with an expanding or flexible conduit, it is preferred to have the additional openings arranged such that the distance to the lower end of the conduit remains constant. In this manner it is ensured that the additional openings are located at a constant height above the liquid level in the well, even when the influx of liquids into the sump of the well increases and, hence, the sump level rises.

In a preferred embodiment the ratio of the cross-sectional area of the additional opening and of the conduit is in the range of 0 to 1, though even larger openings in form of longitudinally extended slits could also be used.

According to a second aspect of the invention there is provided a method for maintaining or reducing a level of liquids at the bottom of a gas producing well comprising the steps of constricting the production gas flow at a location within the well to generate a low pressure zone having a pressure less than the ambient formation gas pressure and providing a conduit to establish a flow path from an upstream location within said well to said low pressure zone.

In a preferred embodiment the method comprises the further step of determining a gas flow rate, a height over which liquids have to be lifted to reach the low pressure zone and a number representing the size of the constriction such that the low pressure in the low pressure zone is sufficiently low to lift liquids over said height. Where possible these steps are performed prior to the deployment of the constriction and conduit.

These and other aspects of the invention will be apparent from the following detailed description of non-limitative examples and drawings.

EXAMPLES

Figure 1A:
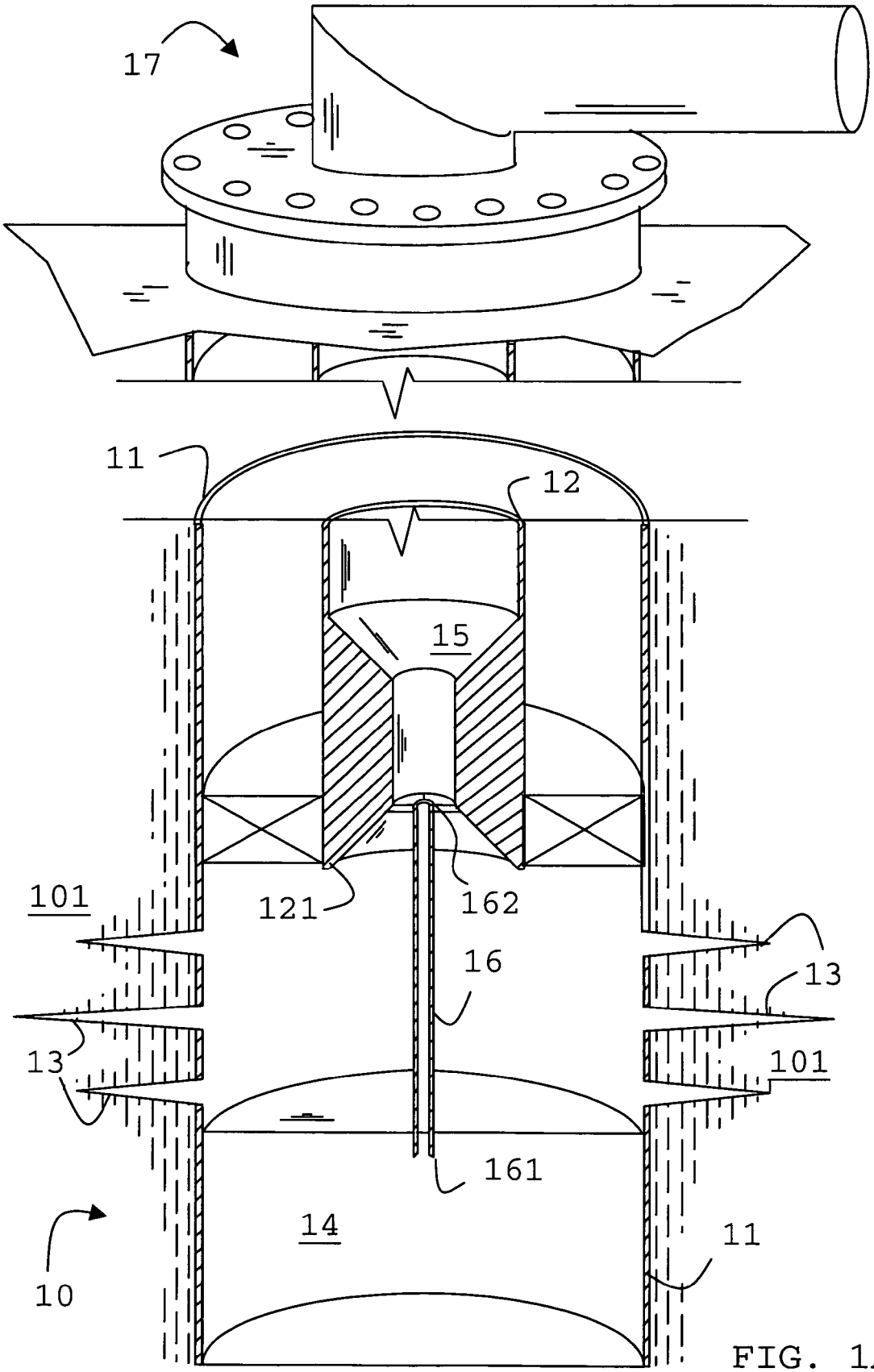
FIG. 1A illustrates elements of an apparatus to pump liquids from the sump of a gas well in accordance with an example of the invention.

Referring first to the schematic drawing of FIG. 1, there is shown a gas well 10 with casing 11 and gas production tubing 12. Perforations 13 penetrate the casing to open a gas producing formation 101. A sump 14 at the bottom of the well 10 is shown filled with water or hydrocarbon condensates.

The present invention proposes to latch onto the terminal end 121 of the production pipe a flow constriction 15. A flow constriction of the type shown, often referred to as a Venturi, is known to generate a pressure differential between the constriction section and the surrounding sections of the flow pipe. The amount of the pressure differential depends mainly on the constriction dimensions, i.e. the diameter of the constriction 15 versus the nominal diameter of the production pipe 12, and the flow rate of the medium passing through it. From the constriction section 15, a small pipe or riser tube 16 provides a fluid communication to a location 161 closer to the bottom of the well. At the surface, there are further gas extraction facilities 17 to produce the gas and handle its transport further down stream.

In operation gas enters the well 10 through the perforations 13 and flows through the constriction section 15, thereby creating a differential pressure DP=P0−P1. The lower pressure P1 at the constriction lifts liquids from sump. The liquid exits the upper opening or nozzle 162 of the riser tube 16 as a mist or in an atomized form to be carried to the surface by the gas flow.

It is important to note that the pressure differential P provided by the constriction may not be sufficient to lift liquids from the sump under some flow rate regimes. To improve the device, one or more venting holes or opening 163 can be added to the riser tube at a location between the lower end 161 of the tube 16 and its upper nozzle 162. This variant of the present invention is shown in FIG. 1B.

Through the venting holes 163, gas from the production zone can enter the conduit and mix with the liquids. The resulting mixture has a lower density and can thus be lifted higher by the same differential pressure.

Figure 2A:
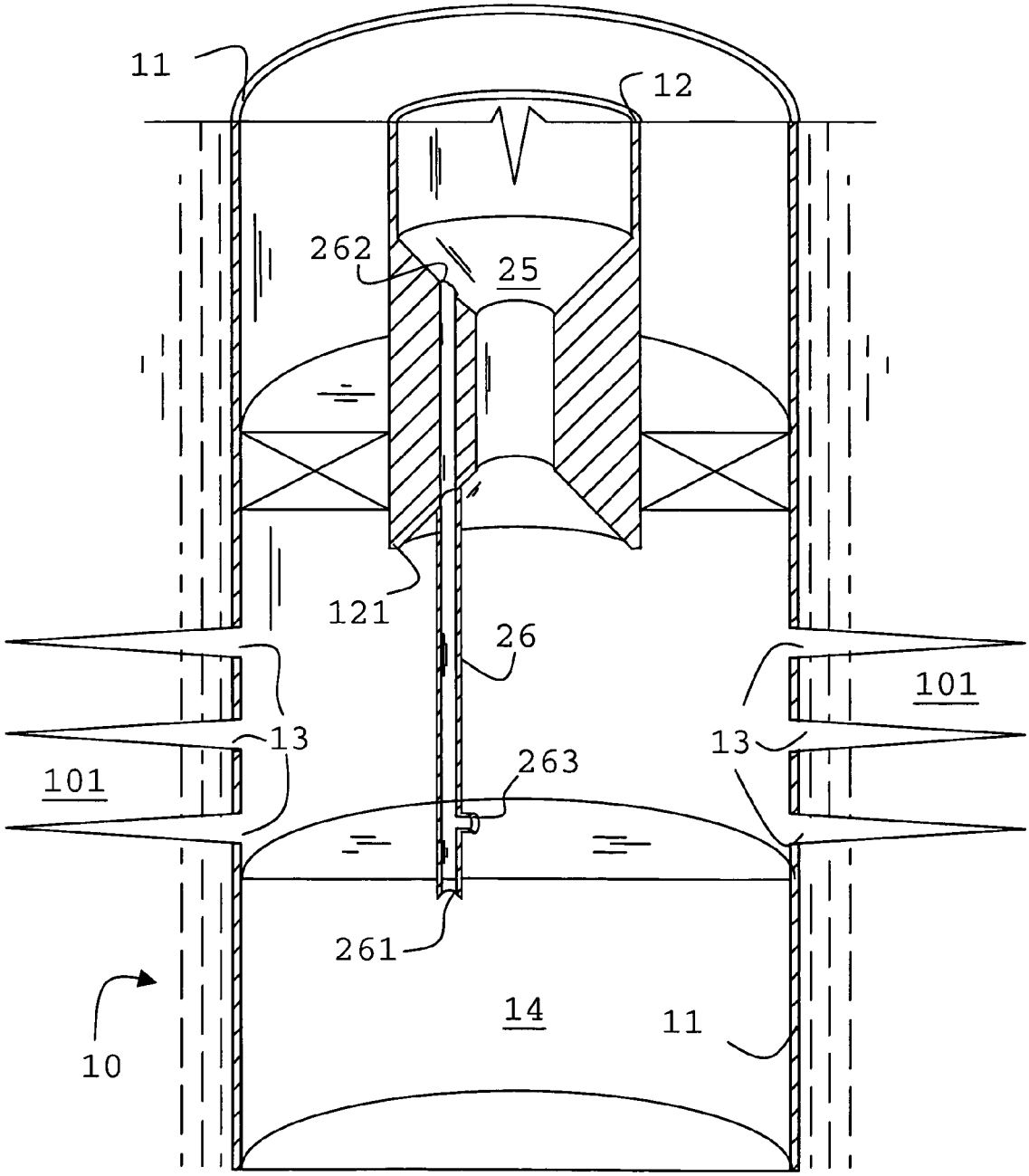
FIGS. 2A–C illustrate further examples of an apparatus to pump liquids from the sump of a gas well in accordance with an example of the invention elements.

In FIG. 2A, there is show another example of an arrangement in accordance with the present invention making use of similar or identical elements to those in the examples described above and hence using similar or identical numerals to refer to those. In the present example, however, a riser tube 26 is arranged in an off-centered position relative to the constriction 25. The riser tube is essentially straight without bends and less of an obstacle within the constriction. The nozzle 262 is located above the throat or narrowest section of the Venturi in a zone where the pressure differential may be slightly reduced when compared to the pressure differential within the throat section itself. However the advantages of having a straight riser tube may outweigh this loss. A venting opening 263 is provided near the bottom end 261 of the riser pipe 26.

Figure 2B:
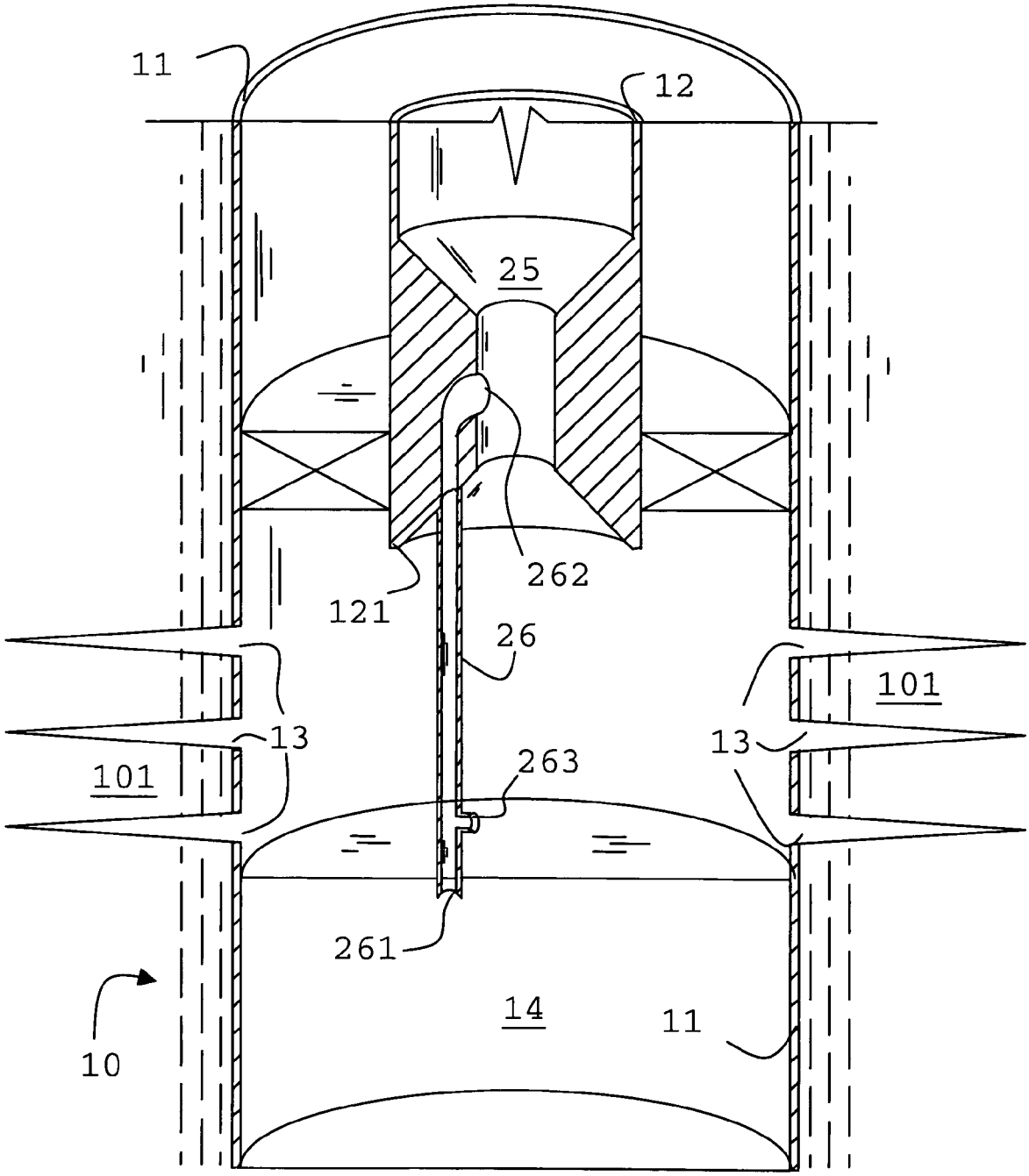

In the variant of FIG. 2B, the riser tube 26 terminates in a funnel 262 that bends to open into the section of the constriction 25 that has the smallest diameter and, hence the highest differential pressure. The opening 262 broadens so as to minimize the pressure drop due to the bend in the flow path of the liquid. A venting opening 263 is provided near the bottom end 261 of the riser pipe 26.

Figure 2C:
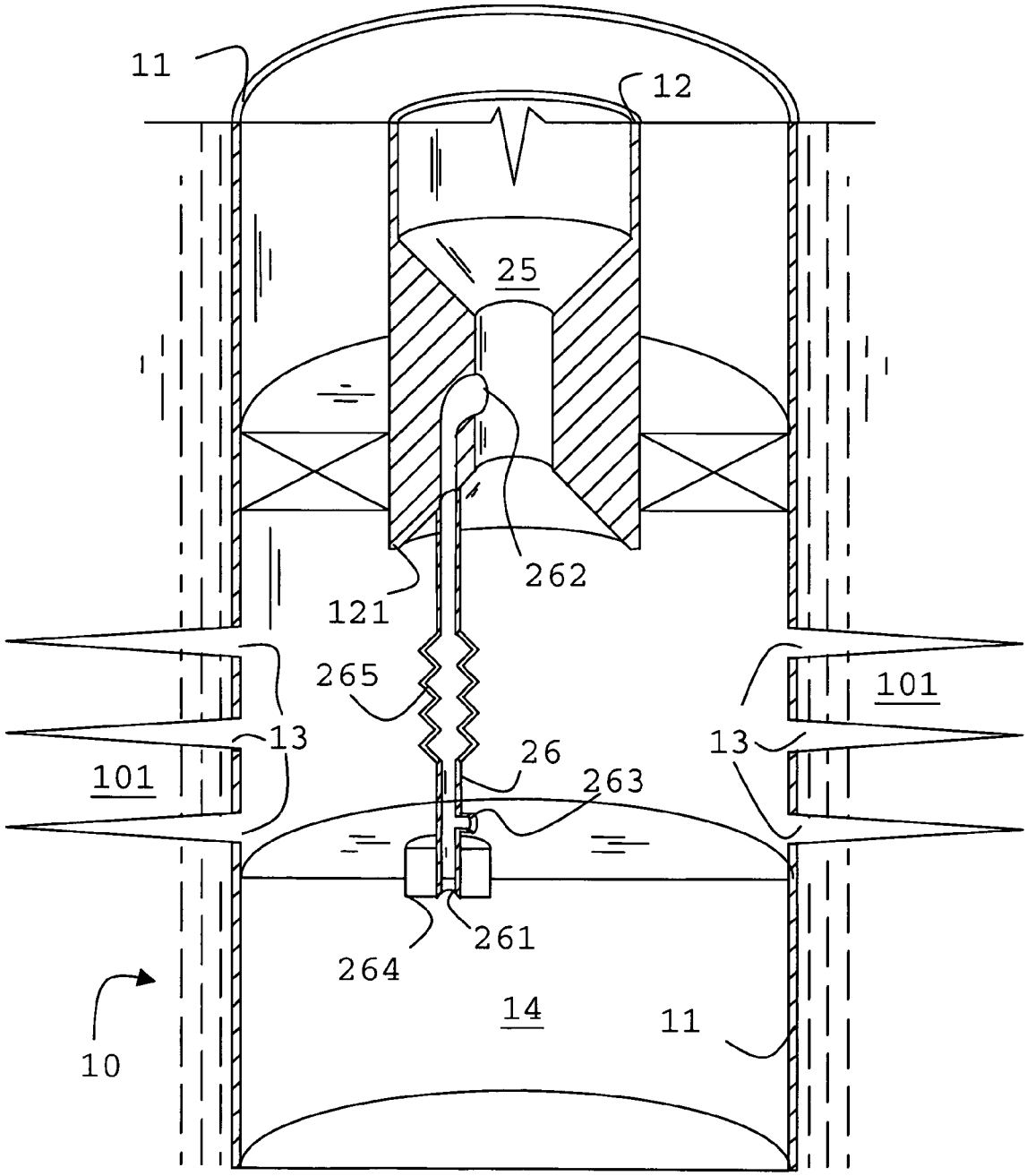

A further variant as illustrated in FIG. 2C, the riser tube 26 carries at its end a floating element 264. In connection with a flexible section 265 of the tube, the floater ensures that the opening 263 is maintained at a constant height above the liquid level 14 in the well 10. The floater element 264 can be a gas tight housing. The flexible section 265 can be implemented as expansion bellows such as shown in FIG. 2C, or as a telescopic joint, or, in fact, as a compliant part of the tube 26 that bends or straightens slightly in dependence of the position of the floater.

Though the precise parameters determining the location and dimensions of the intermediate opening 163, 263 or openings are to be described in more detail below, it is the role of the hole to allow the passage of production gas into the liquid flow within the riser tube 16, 26. The resulting gas/liquid mixture has a lower weight than the liquid and, even a low flow rate of the production gas can be used to lift liquids from the sump. Or, alternatively, the length (or height) of the riser tube 16, 26 and, thus, the height through which the liquid is lifted can be increased at an otherwise constant gas flow rate from the well.

Figure 3:
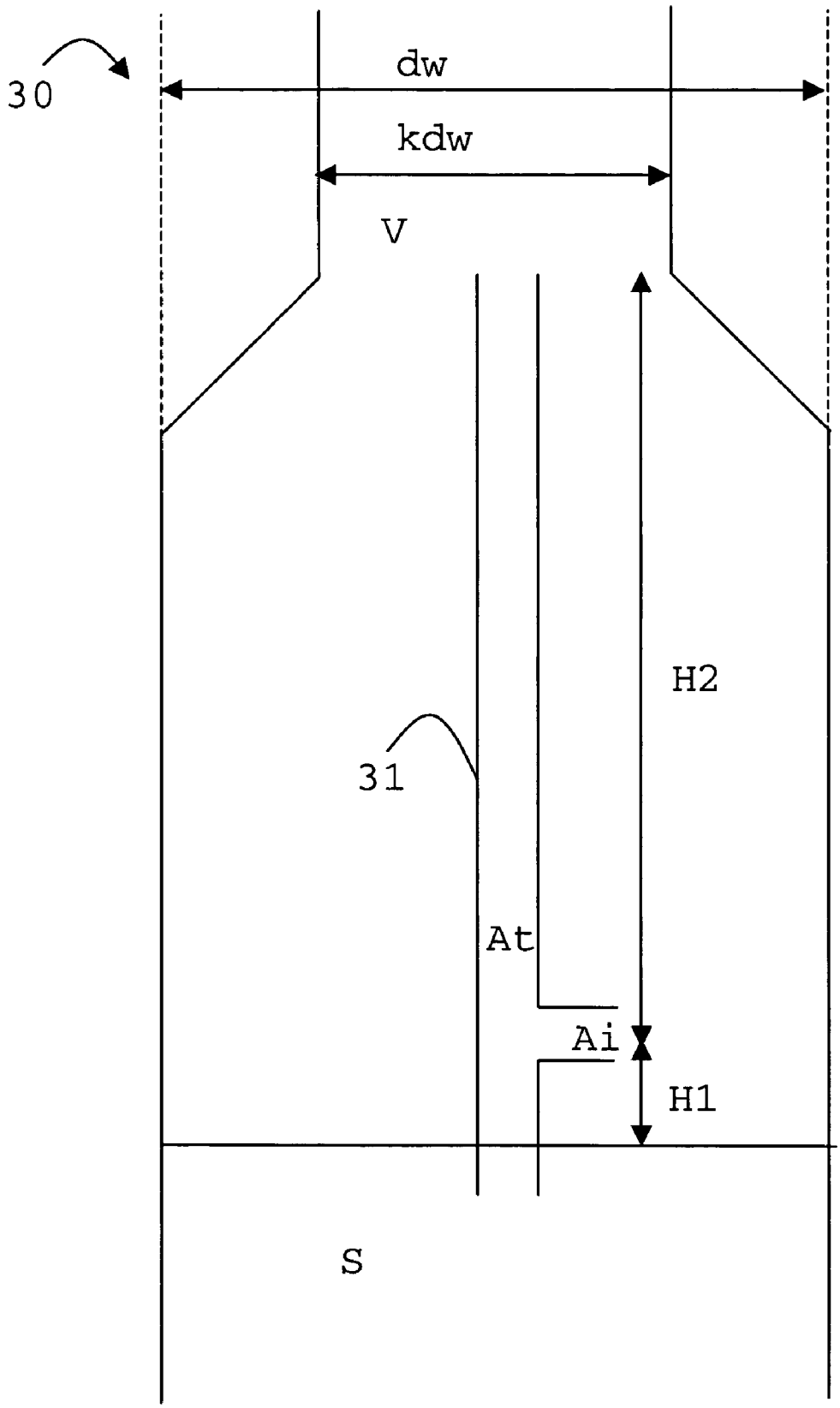
FIG. 3 illustrates important parameters for adapting an apparatus in accordance with the invention to a given well environment.

In the following a detailed description of important design and other parameters is given that can be applied for the purpose of installing and operating devices in accordance with the present invention. Reference is made to FIG. 3 that depicts parameters and coordinates as used in the following.

The Venturi pump 30 in which the main flow of gas creates a differential pressure which is used to lift liquid from the sump S at the bottom of the well to the Venturi throat V, where it will be atomized and then carried upwards with the main gas flow. Liquid droplets may subsequently touch the wellbore walls and form a thin liquid film which flows back downwards, so the process may require several stages.

If the pressure difference between location S and V given by P=PS−PV is sufficiently large, liquid can be lifted from S to V, a total height Ht=H1+H2. Liquid will not flow unless the pressure difference P can overcome the hydrostatic head, i.e. unless $$P>Dl\ g(H1+H2) \quad [1]$$

where Dl is the density of the liquid and g the acceleration due to gravity. The pressure difference P generated by the Venturi is likely to be small, so that the height H1+H2 will be small. Under these conditions the Venturi has to be placed sufficiently close to the pool of liquid to be lifted.

If relation [1] is not valid, gas (of density Dg<Dl) can be introduced into the vertical riser tube at the aperture Ai, so that the density of the gas-liquid mixture in the pipe 31 is reduced to Dm<D1, with Dm sufficiently small that $$P>Dl\ g\ H1+Dm\ g\ H2 \quad [2]$$

In a typical well several parameters are available for optimization amongst which there are the differential pressure P generated by the Venturi constriction, the height H1 of the gas inlet and its cross-sectional area Ai and the cross-sectional area At of the riser tube.

The differential pressure DP in a Venturi due to the flow of the produced gas can be estimated using $$DP=(½)\ Dg\ Ugv^2\ (1-k^4) \quad [3]$$

where Ugv is the gas velocity in the constriction and kdw is diameter of the Venturi constriction as a fraction k of the nominal diameter dw of the gas production tube. The hydrostatic pressure drop in the gas-filled well is added to this pressure DP to obtain $$P=(½)\ Dg\ Ugv^2\ (1-k^4)+Dg\ g\ (H1+H2) \quad [4]$$

The flow can be analyzed in terms of the liquid velocity U1 in the lower riser tube (of length H1), the ratio A=Ai/At of the gas inlet cross-sectional area Ai to that of the riser tube At, B=A sqrt(D1/Dg) where "sqrt" denotes the square root operation, and G=H2 g Dl/P. The latter parameter G can be interpreted as a non-dimensional number indicating the capability of the device to lift liquids from the sump S with G=1 corresponding to the case where the differential pressure P would just be capable of lifting liquid a minimum distance H2 required for the operation of the device.

Using the above parameters an approximation of P can be calculated as $$P=(½)\ Ul^2Dl(1+2A^2+2B\ (1+Dg/Dl)\ \mathrm{sqrt}(1+G\ H1/(Ul^2\ H2)))+(1+2A^2)\ Dl\ g\ H1+\mathrm{H2}\ g\ Dl/Fl \quad [5]$$

where Fl is the liquid volume fraction $$Fl=1/(1+B\mathrm{sqrt}(1+G\ H1/(H2\ Ul^{2)))}$$

Figure 4:
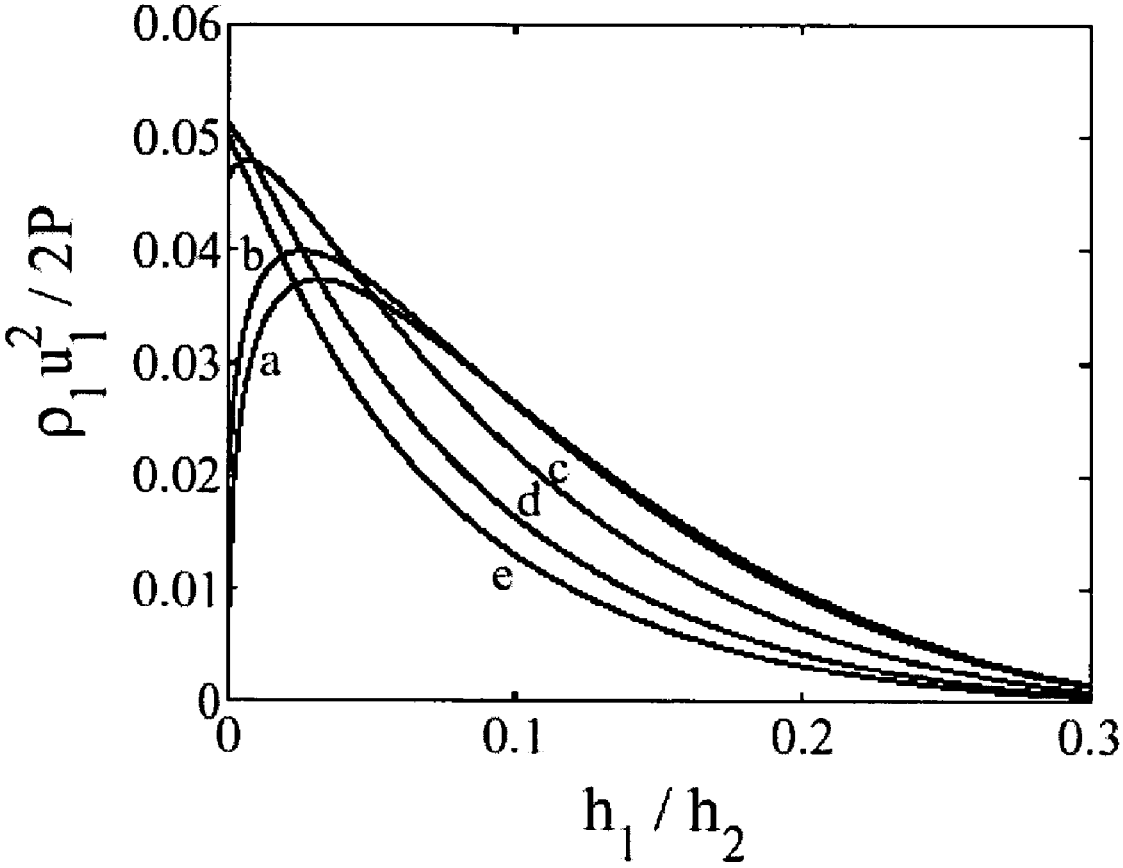
FIG. 4 is a graph useful for a process of adapting an apparatus in accordance with the invention to a given well environment.

Equation [5] can be evaluated either numerically or approximatively. In FIG. 4 there is shown a plot of $Ul^2$ Dl/2P as a function of H1/H2 for different values of the parameter B (Curves a, b, c, d).

When using the novel devices it is important to know the differential pressure P that can be generated by the Venturi pump, given the expected gas flow rate Q in the well, together with the height H2 through which the liquid is lifted. With the knowledge of P, an estimate can be determined of a likely value for G, preferably using a minimal likely value for P. Using then a value of B such that B>G-1. To optimize the liquid flow rate, it is preferred to make B as small as possible whilst maintaining the condition B>G-1 above. A plot similar to that in FIG. 4 can be used to derive an expected liquid velocity Ul , and then select the cross-sectional area At of the main riser tube so that the volumetric flow rate (Ul At) pumped upwards exceeds the rate at which water is thought to be entering the well.

Figure 5:
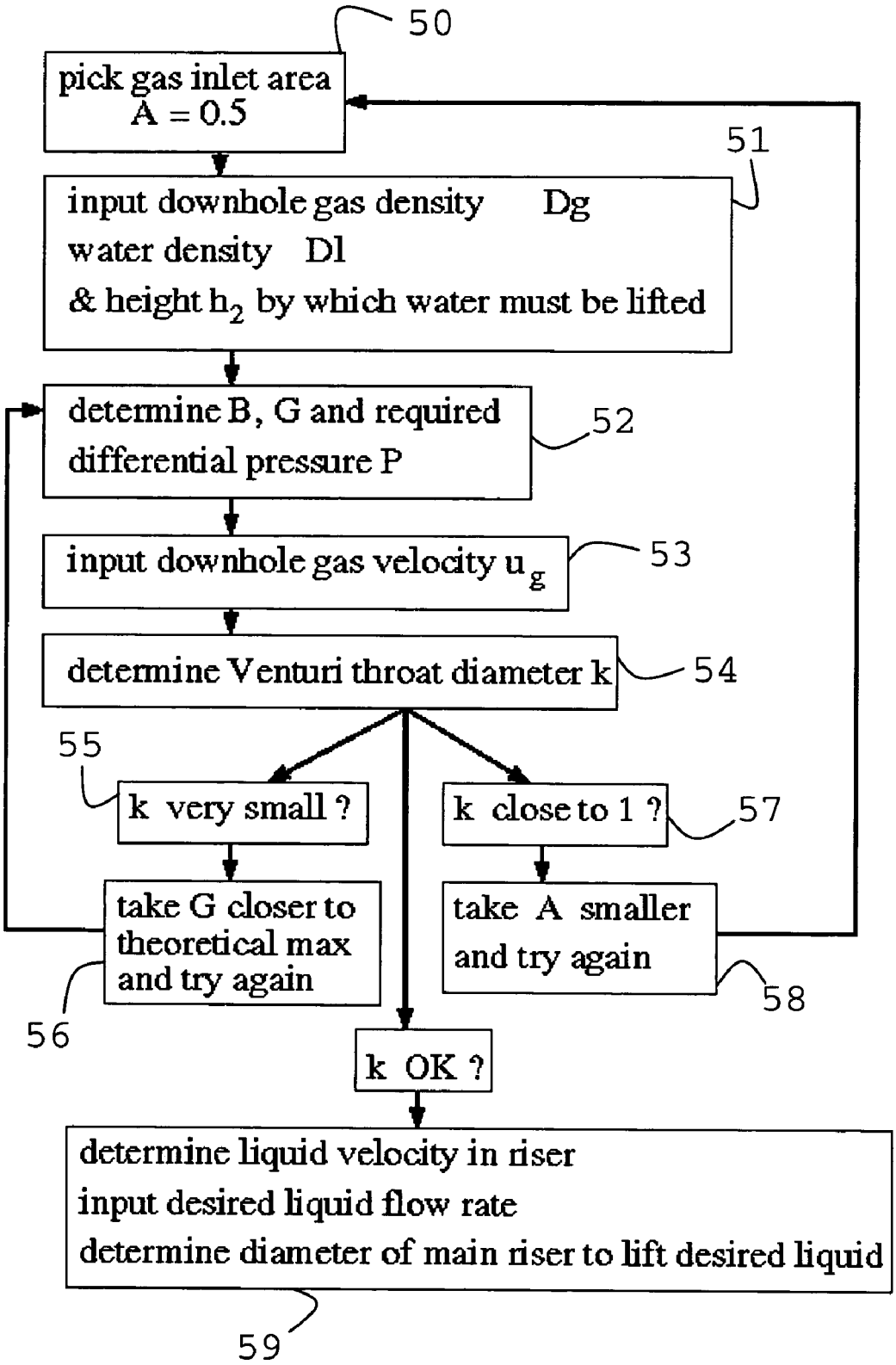
FIG. 5 is a flowchart illustrating a process of adapting an apparatus in accordance with the invention to a given well environment.

The above steps are set out in the flow chart of FIG. 5 including the steps of:

1. Determining a reasonable value for A=Ai/At (STEP 50). The area Ai of the hole through which gas enters the main riser tube (which lifts liquid to the Venturi throat at V in FIG. 3) is likely to be of the order of the cross-sectional area At of the riser tube itself. For example A=0.5 is a possible choice.

2. Given the densities Dl of water and the downhole density Dg of gas, B=A sqrt(Dl/Dg) can be estimated (STEP 51).

3. Assuming that the height H2 is known by which water must be lifted for the device to be functional, i.e., without the opening Ai being blocked, the differential pressure P that has to be generated by the Venturi constriction can be determined (STEP 52).

4. The non-dimensional quantity G=H2 g Dl/P must be smaller than B+1 for the device to operate, and a reasonably safety margin is given by for example the choice $G=2(B+1)^2/(4B+3)$. This gives a value for G and a design target for P. If G<1 it would be possible to lift water to a height H2 without the introduction of gas, however the present example is based on the assumption that G>1.

5. For the design of the Venturi the value k for the ratio of the Venturi throat diameter to its inlet diameter is the most pertinent design parameter. Furthermore an estimate or knowledge of the downhole velocity Ug of the gas and the downhole gas density Dg is required (STEP 53). The differential pressure $DP=(½)\ Dg\ Ugv^2\ (1-k^4)$ allows the calculation of the constriction parameter k (STEP 54).

The value of k must not be so small that the Venturi is likely to become blocked. In case the resulting value of k turns out to be too small (STEP 55), a value of G closer to the maximum B+1 could be chosen (STEP 56), with the risk that such a design would be closer to the theoretical operating limit and would therefore be less robust.

6. If the gas flow rate in the well is high, the value of k obtained in step 5 will be very close to 1 (STEP 57). Under such conditions the amount of gas required to lift the water in the main riser tube is reduced, thereby reducing uncertainty from the design by allowing for a smaller throat diameter (e.g. k=0.5). This leads to an increase in the pressure differential P and the above design procedure can be reversed in order to select A (STEP 58), which will be smaller than the value A=0.5 chosen in STEP 50 as the starting point for the design. Thus in a well with sufficient gas flow there is a greater degree of freedom in choosing the parameters k and A.

7. The water or condensate level within the well is a distance H1 below the point at which gas enters the main riser tube. For the device to operate we require H1/H2<1/G. The range of acceptable values for H1 is therefore not large, and a preferred choice for H1 is close to the value H2/(2G), or within the immediate vicinity of the bottom opening of the riser tube.

8. Equation [5] can be evaluated numerically or through approximations in order to predict the liquid velocity Ul in the bottom section of the riser tube. Typical results of equation [5] are illustrated in FIG. 4. The choice of Ul enables the selection of the diameter of the main riser tube (STEP 59). This diameter is preferably small compared to the diameter of the well and small compared to the throat of the Venturi constriction, in order to ensure that the pressures in the Venturi are not adversely affected by too large an injection of gas/liquid mixture.

The following description represents a way of applying the above steps to a specific well.

The gas flow rate in the well is $0.22\times10^6$ $m^3$/day at STP (1 bar, 15 C=288 K). The downhole pressure and temperature are assumed to be 38 bar and 50 degrees C.

Assuming that the gas is ideal, the volumetric flow rate at downhole conditions is 0.079 $m^3s^{-1}$. The gas production tubing inner diameter ID is 4.4 inches. The tubing cross-sectional area is $S=9.8\times10^{-3}$ $m^2$ so that the downhole velocity in the tubing is vd=8.1 $ms^{-1}$. A gas gravity of 0.65 can be assumed, corresponding to gas density at standard conditions of 0.78 $kgm^{-3}$. The density Dg of the gas at downhole conditions is 25.3 $kgm^{-3}$.

The differential pressure generated by a Venturi with ratio of throat to inlet diameters k=0.5 is 12.4 kPa (1.8 psi) using equation [3]. Evaluating the non-dimensional quantity G=H2 g Dl/P, the pressure required to lift liquid a height H2 divided by the pressure differential generated by the Venturi. The density of water is Dl=1000 $kgm^{-3}$. If H2=15 m then G=11.9; whereas if H2=40 m then G=31.6.

With a smaller Venturi constriction of k=0.35, the differential pressure generated is 54.5 kPa (7.9 psi). If H2=15 m then G=2.7; whereas if H2=40 m then G=7.2.

Choosing a value for B=A sqrt (Dl/Dg) wherein the ratio A=Ai/At of the gas inlet cross-sectional area Ai to that of the riser tube At, and Dg is the downhole gas density. If B<G−1 the device will not operate, because insufficient gas enters the main riser.

The four values of G found above correspond to minimum values B=10.9, 30.6, 1.7, 6.2 and hence to minimum values A=1.7, 4.9, 0.27, 0.99. The first two values are considered not small enough to be valid (inlet area exceeding riser tube area) The last value is close to the practical limit, and corresponds to a gas inlet which has the same cross-sectional area as that of the main riser tube. The most viable design based on the above calculation corresponds to a Venturi with k=0.35 and H2=15 m, for which B=3 (leaving an additional safety margin compared to the minimum value of 1.7) and A=0.48.

Looking at the desired flow rate of 80 $m^3$ of water for every million $m^3$ of gas (at standard conditions), the rate at which water must be raised is 17.6 $m^3$/day=$2\times10^{-4}$ $m^3$ $s^{-1}$. FIG. 4 shows that the velocities are typically greater than Ul=1.0 m $s^{-1}$. The main riser tube therefore has to have an area $2\times10^{-4}$ $m^2$, which corresponds to a pipe of diameter 1.6 cm, which may be compared with the tubing inner diameter 11.17 cm.

The Venturi can be hung onto the tubing level with the top of the perforations with the riser tube bridging the perforated production zone of about 15 m depth, so that water is lifted by H2=15 m. The design above indicates that the Venturi has preferably a throat/inlet diameter ratio k=0.35, as k=0.5 would not suffice, and that the lift height H2=15 m can be attainable. The main riser which lifts water to the Venturi throat would have a diameter of 1.6 cm and a cross-sectional area At=2 $cm^2$. The area Ai of the gas inlet through which gas enters the main riser would be Ai=0.48 At.

Figure 1B:
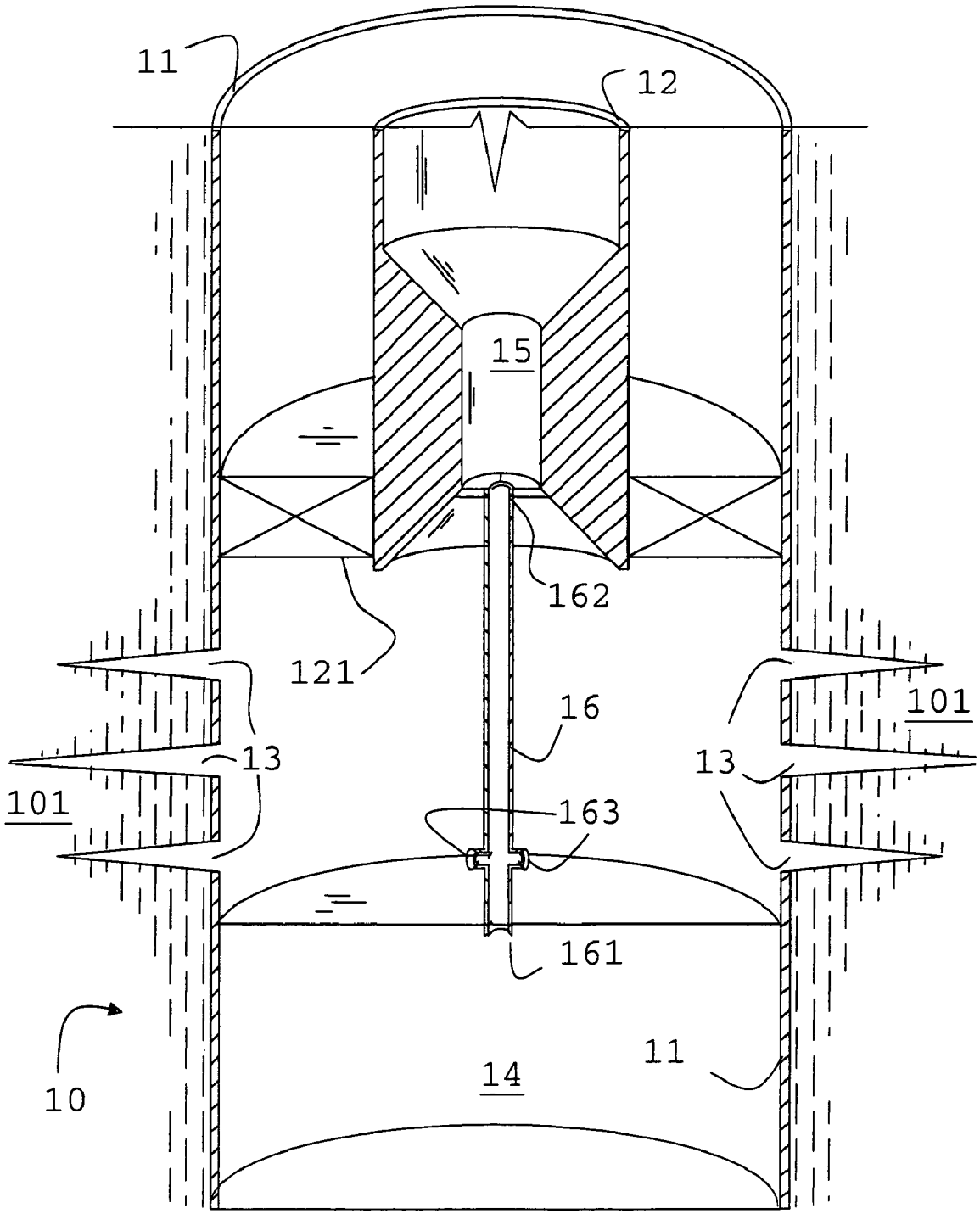
FIG. 1B shows a variant of the example of FIG. 1A.
Figure 6:
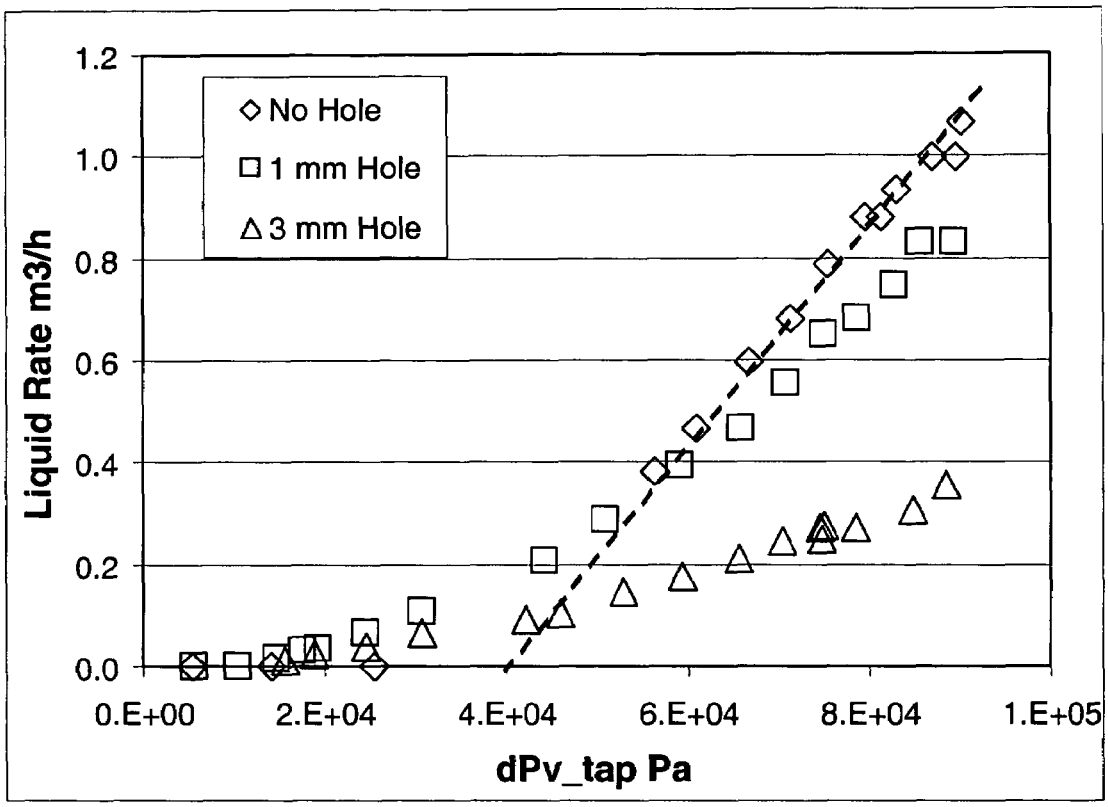
FIG. 6 is a plot comparing the performance of variants of the invention.

Further experimental data are shown in FIG. 6, which illustrates the effects of differently sized venting holes (such as openings 163, 263 in FIGS. 1 and 2). In the graph, the ordinate values indicate the flow rate of liquid extracted from a sump measured in cubic meters per hour. The abscissa indicates the differential pressure in Pascal. The experiment without venting hole—corresponding to a device as shown in FIG. 1A—is denoted by diamond shaped markers. The values derived from an experiment with a 1 mm diameter hole are plotted as squares. And the values derived from an experiment using a 3 mm hole are plotted as triangles.

The experiments demonstrate the beneficial effects of an additional opening at low DP. In addition it is shown that there is a drop in performance when using a larger opening area Ai.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An apparatus for maintaining or reducing a level of liquids at the bottom of a gas producing well comprising:

a constriction or throat section coupled with a production pipe of the gas producing well, wherein production gas flow from the well passing upwards through the constriction or throat section into the production pipe generates a low pressure zone having a pressure less than the ambient formation gas pressure; and a conduit having a first end and a second end, wherein:

the first end is coupled with the constriction or throat section;

the second end is configured to contact the liquids;

the liquids are located at an upstream location relative to the constriction or throat section and the conduit is configured to provide a flow path from the upstream location within said well to said low pressure zone; and the conduit includes one or more openings configured to provide for entry of gas into the conduit.

2. The apparatus of claim 1 wherein the constriction or throat section is a Venturi.

3. The apparatus of claim 1 wherein the one or more openings are configured to provide for the entry of formation gas at locations between the up-stream location and the low pressure zone.

4. The apparatus of claim 3 wherein the one or more openings comprise a single opening for the entry of formation gas at a position between the up-stream location and the low pressure zone.

5. The apparatus of claim 1 wherein the conduit has additional one or more openings are configured to provide for the entry of formation gas passing through the production pipe, the one or more openings being disposed at one or more locations between the up-stream location and the low pressure zone.

6. The apparatus of claim 5 having the one or more openings located around the circumference of the conduit at a single position between the up-stream location and the low pressure zone.

7. The apparatus of claim 1 wherein the conduit is adapted to maintain a constant distance between the one or more openings and the level of the liquids in the well.

8. The apparatus of claim 1 wherein the conduit is straight.

9. The apparatus of claim 1 wherein the first end of the conduit is configured to provide that the conduit terminates above a section of the constriction where the constriction has its smallest diameter.

10. The apparatus of claim 1 wherein the first end of the conduit is configured to provide that the conduit terminates in a section of the constriction where the constriction has its smallest diameter.

11. The apparatus of claim 1 wherein the first end of the conduit is configured to provide that the conduit terminates below a section of the constriction where the constriction has its smallest diameter.

12. The apparatus of claim 1 wherein the up-stream location is below a lowest gas producing perforation.

13. The apparatus of claim 1 wherein the constriction is located above a gas producing zone of perforations.

14. The apparatus of claim 1 wherein the constriction is located above a gas producing zone of perforations and the upstream location is located below said zone.

15. The apparatus of claim 1 wherein the conduit has a length of more than 5 meters.

16. The apparatus of claim 1 wherein ratio of the cross-sectional area of each of the the one or more openings and of the conduit is in the range of 0 to 1.

17. A method for maintaining or reducing a level of liquids at the bottom of a gas producing well comprising the steps of constricting production gas flow flowing into a production pipe at a location within the well to generate a low pressure zone having a pressure less that the ambient formation gas pressure;

providing a conduit in the gas producing well configured to establish a flow path for the liquids disposed at the bottom of the gas producing well, said flow path flowing from the level of the liquids at -an up-stream location within said well to said low pressure zone; and providing at least one opening in the conduit for entry of formation gas into said conduit.

18. The method of claim 17 further comprising the step of determining a gas flow rate, a height over which the liquids have to be lifted to reach the low pressure zone and a number representing the size of the constriction such that the low pressure lifts the liquids over said height.

19. The method of claim 17 further comprising the step of latching a flow constriction onto a bottom section of the production pipe.

20. The method of claim 17 further comprising the step of maintaining the position of the at least one opening at a constant height above the level of the liquids in the well.

* * * * *